US008734310B2

(12) United States Patent
Janzen

(10) Patent No.: US 8,734,310 B2
(45) Date of Patent: May 27, 2014

(54) LOW-NOISE ROTOR CHAMBER FOR A CENTRIFUGE

(75) Inventor: Hans Janzen, Hannover (DE)

(73) Assignee: Thermo Electron LED GmbH, Langenselbold (DE)

( * ) Notice: Subject to any disclaimer, the term of this patent is extended or adjusted under 35 U.S.C. 154(b) by 1074 days.

(21) Appl. No.: 12/685,010

(22) Filed: Jan. 11, 2010

(65) Prior Publication Data

US 2010/0179043 A1 Jul. 15, 2010

(30) Foreign Application Priority Data

Jan. 15, 2009 (DE) ..... 10 2009 004 748

(51) Int. Cl.
*B04B 7/02* (2006.01)

(52) U.S. Cl.
USPC ..... 494/14; 494/60

(58) Field of Classification Search
USPC ..... 494/12, 16–21, 31–34, 43, 60–61, 81, 494/85, 14, 13; 210/360.1
See application file for complete search history.

(56) References Cited

U.S. PATENT DOCUMENTS

| | | | | |
|---|---|---|---|---|
| 3,339,836 | A * | 9/1967 | Mitchell et al. | 494/16 |
| 3,804,324 | A * | 4/1974 | Sinn et al. | 494/14 |
| 4,193,536 | A * | 3/1980 | Kubota | 494/14 |
| 4,221,325 | A * | 9/1980 | Kubota | 494/14 |
| 5,490,830 | A * | 2/1996 | Lovelady et al. | 494/14 |
| 6,007,473 | A * | 12/1999 | Koch et al. | 494/60 |
| 6,062,033 | A * | 5/2000 | Choi | 62/296 |
| 6,063,017 | A * | 5/2000 | Romanauskas et al. | 494/12 |
| 7,331,918 | B2 * | 2/2008 | Hayasaka et al. | 494/12 |
| 7,367,932 | B2 * | 5/2008 | Niinai | 494/12 |
| 2005/0079064 | A1 | 4/2005 | Shimizu et al. | |

(Continued)

FOREIGN PATENT DOCUMENTS

| | | |
|---|---|---|
| CN | 2361699 Y | 2/2000 |
| CN | 2776560 Y | 5/2006 |

(Continued)

OTHER PUBLICATIONS

United Kingdom Intellectual Property Office, Patents Act 1977: Search Report Under Section 17(5), Application No. GB1000389.5, Date of search Mar. 26, 2010 (1 page).

(Continued)

*Primary Examiner* — Charles E Cooley
(74) *Attorney, Agent, or Firm* — Wood, Herron & Evans, LLP

(57) ABSTRACT

The present invention relates to a rotor chamber for a centrifuge, in particular an air-cooled laboratory centrifuge, having a chamber wall, comprising an inner side facing toward the chamber interior, the chamber interior being implemented to receive a centrifuge rotor, and an outer side facing away from the chamber interior, and having a sound barrier which is implemented to reduce the sound emitted from the rotor chamber, which comprises a multilayer damping lining. The first layer comprises a material having essentially sound-absorbing properties relative to the second layer, and the second layer comprises a material having essentially sound-reflecting properties relative to the first layer. The present invention also relates to a centrifuge having such a rotor chamber, and methods for reducing the sound emanating from the rotor chamber of a centrifuge, in particular an air-cooled laboratory centrifuge.

24 Claims, 1 Drawing Sheet

(56) References Cited

U.S. PATENT DOCUMENTS

| | | | | |
|---|---|---|---|---|
| 2005/0233884 | A1* | 10/2005 | Hayasaka et al. | 494/60 |
| 2005/0272587 | A1* | 12/2005 | Niinai | 494/12 |
| 2006/0065808 | A1* | 3/2006 | Chee et al. | 248/346.03 |
| 2010/0179043 | A1* | 7/2010 | Janzen | 494/14 |
| 2013/0178352 | A1* | 7/2013 | Goellnitz et al. | 494/60 |

FOREIGN PATENT DOCUMENTS

| | | | |
|---|---|---|---|
| DE | 597072 | C | 5/1934 |
| DE | 7224033 | U | 10/1972 |
| DE | 197 19 959 | C1 | 8/1998 |
| DE | 29803674 | U1 | 7/1999 |
| DE | 19948118 | A1 | 4/2001 |
| DE | 10313790 | A1 | 9/2004 |
| DE | 10 2004 049 100 | A1 | 6/2005 |
| DE | 10 2004 049 101 | A1 | 6/2005 |
| EP | 0 626 205 | A2 | 11/1994 |
| GB | 1 403 254 | A | 8/1975 |
| JP | 2005221055 | A | 8/2005 |
| JP | 2007156309 | A | 6/2007 |
| WO | 02/071820 | A1 | 9/2002 |

OTHER PUBLICATIONS

Espacenet, English Machine Translation of Abstract of Chinese Patent No. CN2361699Y, Published Feb. 2, 2000, retrieved from http://worldwide.espacenetcom on Jul. 26, 2012 (1 page).

Espacenet, English Machine Translation of German Patent No. DE19948118A1, Published Apr. 26, 2001, retrieved from http://worldwide.espacenet.com on Jul. 26, 2012 (6 pages).

Espacenet, English Machine Translation of German Patent No. DE10313790A1, Published Sep. 30, 2004, retrieved from http://worldwide.espacenet.com on Jul. 26, 2012 (8 pages).

Japanese Patent Office, English Computer Translation of Japanese Publication No. 2005-221055, Published Aug. 18, 2005 (11 pages).

Espacenet, English Machine Translation of Abstract of Chinese Patent No. CN2776560Y, Published May 3, 2006, retrieved from http://worldwide.espacenet.com on Jul. 26, 2012 (1 page).

Japanese Patent Office, English Computer Translation of Chinese Publication No. 2007-156309, Published Jun. 21, 2007 (13 pages).

German Patent Office, Official Action for German Application No. 10 2009 004 748.4-23, dated Oct. 19, 2009 (3 pages).

Japanese Patent Office, Official Action for Japanese Application No. 2010-007217, dated Oct. 25, 2011 (3 pages).

Chinese Patent Office, Official Action for CN201010002959.0, dated Jul. 20, 2012 (3 pages).

* cited by examiner

LOW-NOISE ROTOR CHAMBER FOR A CENTRIFUGE

RELATED APPLICATION

The present application claims the priority under 35 U.S.C. §119 of German Patent Application No. 102009004748.4, filed Jan. 15, 2009, the disclosure of which is hereby incorporated herein by reference in its entirety.

FIELD OF THE INVENTION

The present invention relates to a rotor chamber for a centrifuge, in particular for an air-cooled laboratory centrifuge, having a chamber wall, comprising an inner side facing toward the chamber interior, the chamber interior being implemented to receive a centrifuge rotor, and an outer side facing away from the chamber interior, and having a sound barrier, which is implemented to reduce the sound emitted by the rotor chamber. Furthermore, the present invention relates to a centrifuge having such a rotor chamber, and a method for reducing the sound emanating from a rotor chamber of a centrifuge, in particular an air-cooled laboratory centrifuge.

BACKGROUND OF THE INVENTION

Centrifuges, in particular air-cooled laboratory centrifuges, frequently develop significant background noise, which is sometimes significant, in operation, which is perceived as annoying by individuals located nearby. The causes of the sometimes significant background noise during operation of centrifuges are extraordinarily manifold. Thus, for example, even extremely small imbalance weights in the centrifuge vessel result in a vibration of the centrifuge, which finally causes the development of rattling sounds or similar noise. In addition, the rotor chamber is also responsible for a majority of the noise development of a centrifuge. The fundamental construction of a rotor chamber for a centrifuge is known from the prior art. It provides a typically cylindrical chamber for receiving the rotor. The rotor chamber is typically implemented as open on top for the introduction and removal of samples to be centrifuged and/or for changing the rotor. In contrast, the base area is typically implemented as essentially closed except for a passage for a drive shaft and is fixedly connected to the side wall of the rotor chamber. Overall, the rotor chamber thus has a trough-shaped profile in cross-section. Furthermore, the centrifuge typically comprises a pivotable lid, using which the inner space of the centrifuge comprising the rotor chamber can be closed on top.

The rotor rotating in the rotor chamber of the centrifuge is frequently also implemented so that in the rotating state, it provides cooling air for cooling the attached centrifuged material and the other components situated in the inner area and optionally also the components lying further in the outside area, depending on the guiding of the cooling air. However, in particular this airflow results during operation of the centrifuge in interference with the rotor flow propagating as sound waves under certain circumstances, which is acoustically perceptible as a discrete tone. The excitation of the rotor chamber to vibrations, which in turn generate airborne noise in the surrounding air, caused by the rotation of the rotor, is the origin of the occurrence of this tone.

Fundamental measures for reducing the total balance of the noise development of a centrifuge are already known in the prior art. Thus, for example, the flapping noises caused by the vibration of the centrifuge and/or the housing may be reduced, inter alia, by the use of appropriate elastic bearings, cushioned feet, etc. A further possibility is known from DE 197 19 959 C1, which discloses a laboratory centrifuge, comprising, inter alia, a base group having a rotor drive motor on a baseplate, which, together with an angled front panel, has the operating elements and display instruments typical in laboratory centrifuges. The base group is produced from a coherent metal plate, in which at least two parallel rows of decoupling slots are located in the curved area of the metal plate adjoining the front panel and the baseplate, which form a meandering web connection between front plate and baseplate, whereby a noise development or structure-borne noise caused by imbalance on the rotor is significantly reduced in the direction of the front plate. Furthermore, the integration of sound-reducing materials in the area of the centrifuges is known. For this purpose, for example, DE 72 24 033 U1 proposes the use of a polyurethane hard foam which also acts, inter alia, as a sound barrier. A sound barrier is to be understood in the scope of the invention as an apparatus in a centrifuge which reduces or even prevents the propagation of noise in at least one spatial direction.

However, it has been shown that the noise development of centrifuges is still comparatively high in spite of the preceding measures and is still perceived as annoying. It is therefore the object of the invention to disclose possibilities for reducing the noise development of a centrifuge, in particular an air-cooled laboratory centrifuge, still further.

SUMMARY OF THE INVENTION

An aspect of the present invention is that the sound barrier is a damping lining, having at least one first layer and one second layer, which covers at least one subarea of the chamber wall, the first layer and the second layer are situated lying at least partially flatly one on top of another, and the first layer comprises a material having essentially sound-absorbing properties relative to the second layer and the second layer comprises a material having essentially sound-reflecting properties relative to the first layer.

The rotor chamber is ultimately used for receiving the centrifuge rotor rotating therein and is therefore particularly susceptible to the pressure waves caused by the rotor movement in the rotor chamber interior, which excite the rotor chamber to vibrations, so that it emits noise in the form of airborne sound. According to the present invention, to improve the sound-reducing properties, at least a subarea of the chamber wall of the rotor chamber is implemented having a damping lining, which reduces the sound emitted from the chamber wall and thus acts as a sound barrier. The damping lining according to the present invention is implemented as multilayered and in particular two-layered, comprising at least one first layer and one second layer. Particularly efficient sound minimization is achieved by the adaptation of the materials used in the first and second layers according to the present invention, which is described in greater detail hereafter, in particular in frequency ranges from 100 to 1000 Hz and very particularly in ranges from 100 to 500 Hz. The combination of the materials is in no way arbitrary, but rather is based on the concept of combining materials having essentially noise-absorbing properties with materials having essentially noise-reflecting properties together in one element for noise reduction and/or in a sound barrier. Only this combination according to the present invention allows the outstanding noise minimization results.

Sound-reflecting is to be understood in the meaning of sound damping, wherein the sound propagation of airborne sound or structure-borne sound is counteracted by reflection of sound waves. Sound-absorbing, in contrast, essentially relates to sound damping, which reduces the sound propagation by absorption of sound waves, through which the sound energy is converted into inaudible vibration energy waves and/or dissipated. A basic idea of the present invention is thus that the sound barrier also comprises multiple or at least two materials employing different sound-reducing principles (specifically sound-absorbing and sound-reflecting), which supplement one another in their sound-reducing properties. In the present case, a suitable adaptation of the at least two layers of the damping lining to one another is thus particularly important. It is obvious that in the scope of the present invention, a material having essentially sound-absorbing properties can also have sound-reflecting properties to a certain extent and vice versa. Rather, it is decisive that the first layer has more pronounced sound-absorbing properties than the second layer and the second layer has more pronounced sound-reflecting properties than the first layer.

The term "material" is also not to be understood as restricted to individual materials in the meaning of the present invention, but rather also particularly comprises material mixtures, multicomponent parts, etc. The first and/or the second layers may thus comprise one material in the scope of the present invention, which is a mixture of multiple materials or individual components, for example.

The first layer and the second layer are also situated lying at least partially flatly on one another. A configuration lying flatly on one another is to be understood in particular to mean that the first layer and the second layer lie one behind another in the radial direction to a rotor situated in the rotor chamber and directly adjoin one another. In this area, the damping lining is thus implemented as a multilayer material composite and/or has a sandwich-type construction. The proportion of the overlap area can vary for each of the two layers, however, the sound reduction achieved by the damping lining being better the larger the overlapping areas of the first and the second layer are and/or the greater the proportion of the area of the rotor chamber wall is in which the at least two layers of the damping lining are implemented lying one on top of another.

Furthermore, the damping lining is at least partially attached to the surface of the rotor chamber, so that in this area vibrations of the rotor chamber may be absorbed directly by the damping lining. The damping lining acts here in relation to the rotor chamber as a vibration mass damper or vibration damper, the damping lining representing a counter-oscillating mass relative to the rotor chamber wall. This effect is particularly clearly pronounced if, as described in greater detail hereafter, the first layer is situated between the second layer and the rotor chamber wall and comprises a material having sufficient elasticity. In particular with this type of configuration, the dissipation effect of the sound barrier is thus based, inter alia, on a mass-spring action principle, energy being withdrawn from the structure to be calmed in that the composite material is implemented as counter-oscillating. This construction allows a dissipation in heat into the elastic part and/or into the damping lining.

The concrete configuration of the damping lining on the rotor chamber can be varied in manifold ways in the scope of the present invention. Thus, for example, particularly good sound reduction results may be achieved if the first layer is situated pressing flatly directly against the rotor chamber on its side facing away from the second layer. At least in the overlap area of the first and the second layers, the first layer is thus situated between the second layer and the rotor chamber and/or produces a connection between the rotor chamber and the second layer in this area. This configuration has the result that firstly the material having the essentially sound-absorbing properties (relative to the second layer) adjoins the rotor chamber and it is at least partially covered by the material having sound-reflecting properties of the second layer on its outer side in relation to the rotor chamber. Sound waves which pass the first layer away from the rotor toward the second layer are thus reflected thereby to the sound-absorbing material, whereby an emission of the sound waves to the environment is prevented, on the one hand, and the total absorption of sound waves by the first layer is increased, on the other hand, and the sound reduction is thus improved.

Furthermore, it is particularly advantageous to attach the damping lining to the outer side of the rotor chamber. Fundamentally, the configuration of the damping lining on the inner side of the rotor chamber is also possible, which also results in a reduction of the sound emanating from the rotor chamber. However, the attachment of the damping lining to the outer side of the rotor chamber is more efficient, in particular having the second layer lying on the outside, so that the sound waves passing the sound-absorbing first layer are reflected toward the rotor chamber by the second layer. In particular with this special configuration, a majority of the damping effect may also be attributed to the mass-spring action principle already described above, especially if the first layer comprises a material which is elastic and has a lesser density than the material of the second layer.

The shape and the distribution of the damping lining on the rotor chamber are also variable in the scope of the present invention. The damping lining thus comprises at least two individual segments in its entirety in a preferred embodiment, which are situated without overlap and particularly opposite to one another on the chamber wall. The at least two individual segments are particularly preferably implemented having uniform shapes and are situated uniformly spaced apart from one another on the rotor chamber. However, it is particularly preferable to implement the damping lining as completely circumferential and pressing against the entire area in at least a subarea of the rotation chamber, i.e., to implement it in the form of a circular ring for a rotor chamber wall in the form of a hollow cylinder.

The sound reduction of the sound emanating from the rotor chamber is also particularly successful if the damping lining is situated in the upper area of the rotor chamber, in particular in the upper half. As already described above, the rotor chamber has a typically hollow-cylindrical side wall and a base area, so that overall a trough-like cross-section of the rotor chamber results. This fundamental construction has the result that the rotor chamber is particularly susceptible to vibration in the upper area in particular, i.e., in the area of the side walls adjoining the engagement opening to the rotor chamber, so that this area provides a significant contribution to the noise development of the sound emanating from the rotor chamber. A configuration of the damping lining precisely in this area of the rotor chamber, and in particular on the outer side of this area of the rotor chamber, thus allows a particularly efficient sound reduction in relation to the area covered by the sound barrier.

The sound reduction is also particularly efficient if the damping lining annularly encloses the rotor chamber, in particular coaxially to the rotation axis running through the rotor chamber. This applies very particularly for a configuration of this damping lining in the upper area of the rotor chamber. The annular configuration is preferred in that the rotor chamber revolves uninterrupted at least in this area and thus no openings exist in the damping lining in this area, which allow sound to escape from the rotor chamber, comparable to a leak. It is obvious that this damping lining ring does not have to be implemented integrally, but rather multipart configuration possibilities, for example, having adjoining individual segments, are also included in the scope of the invention.

An aspect of the present invention is thus, as already described above, the adaptation of the material of the first layer in relation to the material of the second layer. It has proven to be particularly favorable if the second layer has a higher density than the first layer. Materials having a higher density typically have more sound-reflecting properties than materials having a lower density, while in contrast materials having a lower density typically have more sound-absorbing properties than materials having a higher density.

A further adaptation criterion according to the present invention can be the variation of the layer thicknesses of the first layer and the second layer. The layer thickness is to be understood in the present case as the thickness of the first layer and the second layer in the radial direction to the rotational axis running through the rotor chamber. The layer thickness of the first layer is preferably between 2 and 30 mm, in particular between 5 and 20 mm. The second layer is implemented as significantly thinner in comparison thereto, in particular having a layer thickness of at most 0.5 mm.

A broad spectrum can also be used in the material selection of the first layer and the second layer. It is particularly decisive for the material selection of the first layer that it has compression values at which the material is still sufficiently soft to absorb and no longer dissipate vibrations. The material of the first layer is particularly preferably a soft elastomer or a foam material, for example, in particular a polyurethane foam or a polyolefin foam, the latter in the form of a polyethylene foam in particular, for example.

In contrast, the second layer preferably essentially comprises ethylene-propylene-diene rubber (EPDM), ethylene vinyl acetate (EVA), polyurethane (FUR), or polyvinyl chloride (PVC).

Furthermore, a second layer whose material has a weight per unit area of 0.5 $kg/m^2$ to 6 $kg/m^2$, and very particularly 1.5 $kg/m^2$ to 4 $kg/m^2$, is particularly suitable for achieving the advantages according to the invention.

Fundamentally, numerous fastening alternatives can also be employed for fastening the sound barrier to the rotor chamber. However, the use of a self-adhesive coating has proven to be particularly advantageous, in particular on the first layer, via which the sound barrier is fixed on the rotor chamber. Pressure-sensitive adhesives are particularly suitable for this purpose. Using such a self-adhesive coating, the sound barrier can be attached to the rotor chamber particularly easily. In addition, of course, it is also possible to connect the first layer to the second layer via a corresponding self-adhesive coating and not provide the two layers innately connected to one another. For this purpose, the first layer and/or the second layer has an appropriate coating. Through the combination of the various possibilities described above, the invention thus also comprises a rotor chamber having a damping lining, in which the layer adjoining the rotor chamber directly has a coating on both sides and can thus be fastened firstly on the rotor chamber, for example, and subsequently the further coating can be used for fixing the further layer. The particular configuration of self-adhesive coatings on the first and/or the second layers thus allows a particularly multifaceted combination spectrum of installation possibilities and production pathways.

Furthermore, it is particularly advantageous if the chamber wall has an edge implemented pointing away from the chamber interior in the upper area of the rotor chamber, which protrudes beyond the damping lining in the radial direction to the rotational axis. The damping lining is thus implemented as narrower in its radial thickness in the radial direction than the thickness of the edge. This embodiment is particularly favorable in that the additional space required for the damping lining is comparatively slight. This embodiment is therefore also particularly well suitable for retrofitting purposes.

A further aspect of the present invention is a centrifuge which comprises a rotor chamber as described above and is therefore distinguished by a particularly low-noise mode of operation. This is true in particular for an air-cooled laboratory centrifuge having such a rotor chamber, because the noise development occurring through the air swirling inside the rotor chamber is reduced particularly efficiently.

Outstanding results in regard to the sound reduction may also be achieved using a centrifuge, in particular an air-cooled laboratory centrifuge, in which the rotor chamber is received at least in its base area in a molded part, which is particularly implemented as trough-like, and which essentially comprises a sound-reducing material. Sound-reducing materials of this type are known from the prior art. However, the use of a foam molded part has proven to be particularly suitable, in particular made of a viscoelastic polyurethane foam. Furthermore, of course, it is possible to equip the centrifuge with additional sound-reducing means. These may be appropriate diffusers, bearings which reduce structure-borne noise, decoupling slots on the housing, etc., for example.

The effects of the molded part supplement the effects of the damping lining particularly favorably if the rotor chamber is seated in the molded part so that the molded part and the damping lining are free of overlap in the axial direction. Molded part and damping lining thus merge into one another nearly continuously and therefore have hardly any gaps in their entirety, via which undamped emission of sound waves from the rotor chamber is possible.

Finally, a further aspect of the present invention is a method for reducing the sound emanating from the rotor chamber of a centrifuge, in particular an air-cooled laboratory centrifuge, comprising the combination of the following steps: a) absorbing the sound using a first layer and b) reflecting the sound using a second layer. The basic concept of the invention is thus expanding the damping lining in its property spectrum so that it comprises both sound-absorbing and also sound-reflecting properties. For this purpose, at least one first layer and one second layer are combined with one another, the first layer having essentially sound-absorbing properties in relation to the second layer and the second layer having essentially sound-reflecting properties in relation to the first layer. The method according to the present invention thus allows particularly efficient reduction of the sound emanating from the rotor chamber of a centrifuge simultaneously using multiple sound reduction principles.

The method according to the present invention is particularly efficient if the reflection of the sound occurs essentially in the direction of the first layer. It is thus ensured that the sound reflected from the second layer is directed toward the sound-absorbing first layer and the sound absorption is thus increased further. This is achieved, for example, in that the sound barrier is situated in the radial direction toward the rotational axis of a rotor in the rotor chamber on the outer wall of the rotor chamber, the first layer being situated between the rotor chamber outer wall and the second layer.

BRIEF DESCRIPTION OF THE DRAWINGS

The present invention is explained in greater detail hereafter on the basis of the exemplary embodiments shown in the figures. In the schematic figures.

DETAILED DESCRIPTION OF THE INVENTION

Figure 1:
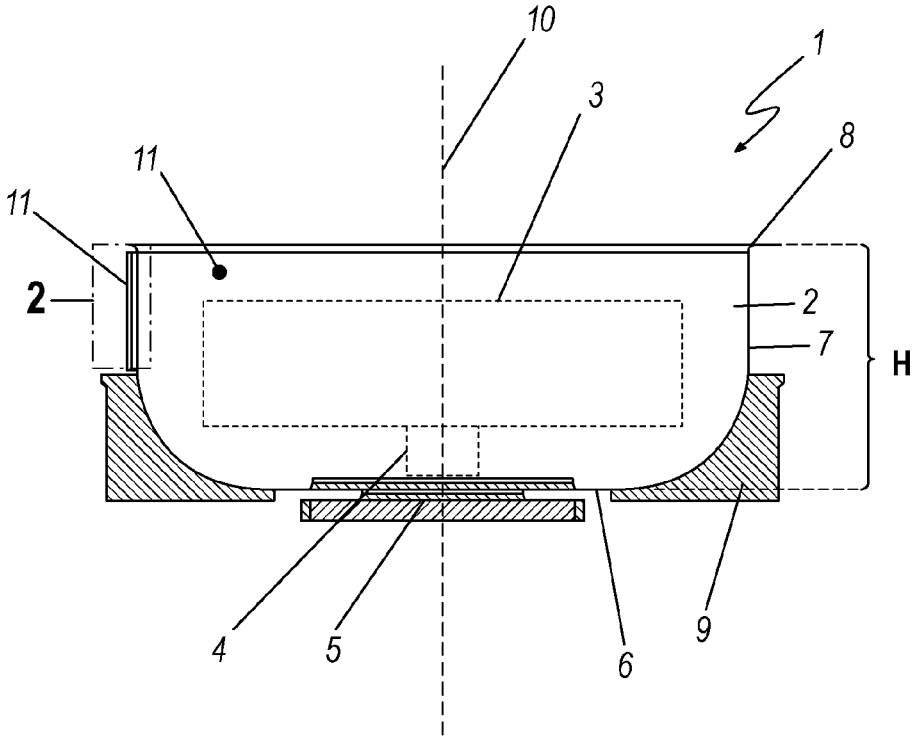
FIG. 1 shows a cross-sectional view through a rotor chamber mounted in a molded part.

Referring now to the figures, identifical components are provided with identical reference numerals in the embodiments shown hereafter.

The centrifuge 1, which is only partially shown in FIG. 1, comprises a rotor chamber 2 in a housing (not shown) for receiving a rotor 3 indicated by dashed lines (in particular a swing-out rotor), which is connected via a drive shaft 4 to a motor element 5. The rotor chamber 2 also comprises a flat base area 6, a wall area 7 adjoining thereon on top, and an upper edge area 8. The rotor chamber 2 is implemented as open on top and is covered to the outside in operation by a lid (not shown). Furthermore, in its lower area the rotor chamber 2 is received in a foam molded part 9 implemented as trough-like, which extends from the base area 6 up to approximately half the height H of the rotor chamber 2. A damping lining 11 adjoins the foam molded part 9 on top in the direction of the rotational axis 10, around which the rotor 3 rotates in operation of the centrifuge 1, so that the foam molded part 9 and the damping lining 11 merge into one another nearly continuously and without overlap in the axial direction.

Figure 2:
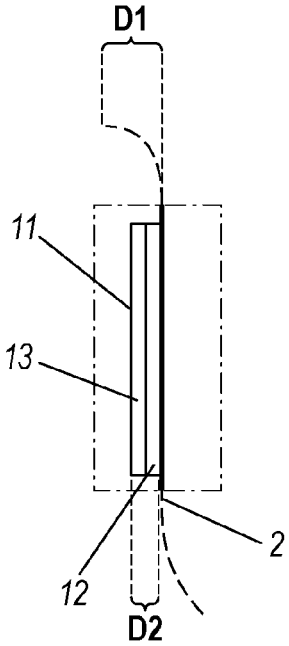
FIG. 2 shows a detail enlargement of the sound barrier from FIG. 1.

The construction of the damping lining 11 acting as a sound barrier is shown enlarged in the detail enlargement in FIG. 2. Accordingly, the damping lining 11 has a sandwich-type construction having a first layer 12 and a second layer 13. The first layer 12 comprises a polyurethane foam, and thus has essentially sound-absorbing properties in comparison to the second layer 13, and directly adjoins the outer wall of the rotor chamber 2 via a self-adhesive coating (not shown in greater detail). The second layer 13 adjoins on the side of the first layer 12 opposite to the rotor chamber 2, which comprises an ethylene-propylene-dyne rubber in the present exemplary embodiment and has essentially sound-reflecting properties in relation to the first layer 12. This special construction has the result that sound waves emitted from the rotor chamber 2 are firstly emitted in the direction of the first layer 12 having essentially sound-absorbing properties in the area of the damping lining 11. Those sound waves which pass the first layer 12 and are not absorbed thereby are subsequently incident on the second layer 13 having essentially sound-reflecting properties, which deflects the sound waves and reflects them in the direction of the first layer 12. In this way, these sound waves may be absorbed by the first layer 12, so that the sound emission of the rotor chamber is significantly reduced.

Figure 3:
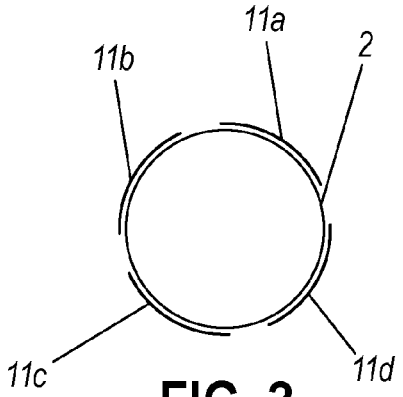
FIG. 3 shows a top view of a rotor chamber having a segmented sound barrier.
Figure 4:
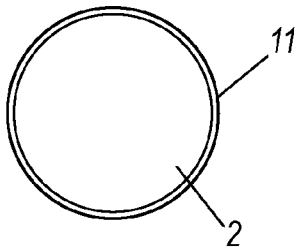
FIG. 4 shows a top view of a rotor chamber having a peripheral sound barrier.

According to the exemplary embodiment shown in FIGS. 1 and 2, the damping lining 11 passes only partially around the rotor chamber 2. In comparison thereto, the two top views according to FIGS. 3 and 4 illustrate further possible configurations of the damping lining 11. In addition to the segmented configuration according to FIG. 3, in which the damping lining 11 is divided into the four individual segments 11*a*, 11*b*, 11*c*, and 11*d*, which are each situated spaced apart from one another by an intermediate space on the outer wall of the rotor chamber, FIG. 4 shows a circumferential damping lining 11 in the form of a circular ring in the radial direction around the rotor chamber 2.

In addition, the total thickness D2 of the sound barrier is narrower than the thickness D1 of the outwardly curved edge in the edge area 8 of the rotor chamber 2. The edge thus protrudes beyond the sound barrier in the radial direction and thus represents a mechanical protection, for example.

What is claimed is:

1. A rotor chamber for a centrifuge having a chamber wall, comprising an inner side facing toward the chamber interior, the chamber interior being implemented to receive a centrifuge rotor, and an outer side facing away from the chamber interior, and having a sound barrier situated on the chamber wall which is implemented to reduce the sound emanating from the rotor chamber, wherein the sound barrier is a damping lining covering at least a subarea of the chamber wall and having at least one first layer and one second layer, the first layer and the second layer being situated lying at least partially flatly one on top of the other, with the first layer comprising a material having essentially sound-absorbing properties relative to the second layer, and the second layer comprising a material having essentially sound-reflecting properties in relation to the first layer.

2. The rotor chamber according to claim 1, wherein the first layer is situated pressing flatly directly on the rotor chamber on its side facing away from the second layer.

3. The rotor chamber according to claim 1, wherein the damping lining is situated on the outer side of the rotor chamber.

4. The rotor chamber according to claim 1, wherein the damping lining comprises at least two individual segments in its entirety, which are situated without overlap and particularly opposite to one another on the chamber wall.

5. The rotor chamber according to claim 1, wherein the damping lining is situated in the upper area of the rotor chamber.

6. The rotor chamber according to claim 5, wherein the damping lining is situated in the upper half of the rotor chamber.

7. The rotor chamber according to claim 1, wherein the damping lining annularly encloses the rotor chamber.

8. The rotor chamber according to claim 7, wherein the damping lining annularly encloses the rotor chamber coaxially to the rotational axis running through the rotor chamber.

9. The rotor chamber according to claim 1, wherein the second layer has a higher density than the first layer.

10. The rotor chamber according to claim 1, wherein the first layer has a layer thickness between 2 and 30 mm.

11. The rotor chamber according to claim 10, wherein the first layer has a layer thickness between 5 and 20 mm.

12. The rotor chamber according to claim 1, wherein the first layer essentially comprises a foam material.

13. The rotor chamber according to claim 12, wherein the first layer essentially comprises a polyurethane foam or a polyolefin foam.

14. The rotor chamber according to claim 1, wherein the second layer has a weight per unit area of 0.5 kg/m2 to 6 kg/m2.

15. The rotor chamber according to claim 14, wherein the second layer has a weight per unit area of 1.5 kg/m2 to 4 kg/m2.

16. The rotor chamber according to claim 1, wherein the second layer essentially comprises ethylene-propylene-dyne rubber (EPDM), ethylene vinyl acetate (EVA), polyurethane (PUR), or polyvinyl chloride (PVC).

17. The rotor chamber according to claim 1, wherein the damping lining has a self-adhesive coating, which is implemented to fix the damping lining on the rotor chamber.

18. The rotor chamber according to claim 17, wherein the first layer of the damping lining has a self-adhesive coating, which is implemented to fix the damping lining on the rotor chamber.

19. The rotor chamber according to claim 1, wherein the chamber wall has an edge implemented pointing away from the chamber interior in the upper area of the rotor chamber, which protrudes beyond the damping lining in the radial direction.

20. A centrifuge having a rotor chamber according to claim 1.

21. The centrifuge according to claim 20, wherein the rotor chamber is received, at least in its base area in a molded part, which essentially comprises a sound-reducing material.

22. The centrifuge according to claim 21, wherein the rotor chamber is seated in the molded part in such a way that the molded part and the damping lining are free of overlap in the axial direction.

23. The centrifuge according to claim 20, wherein the centrifuge comprises an air-cooled laboratory centrifuge.

24. The rotor chamber according to claim 1, wherein the centrifuge comprises an air-cooled laboratory centrifuge.

* * * * *

UNITED STATES PATENT AND TRADEMARK OFFICE

CERTIFICATE OF CORRECTION

PATENT NO. : 8,734,310 B2
APPLICATION NO. : 12/685010
DATED : May 27, 2014
INVENTOR(S) : Hans Janzen It is certified that error appears in the above-identified patent and that said Letters Patent is hereby corrected as shown below:

In the Specification:

In column 7, line 10, change "identifical components" to --identical components--.

In the Claims:

In claim 14, column 8, line 64, change "0.5 kg/m2 to 6 kg/m2" to --0.5 kg/$m^2$ to 6 kg/$m^2$--.

In claim 15, column 8, line 67, change "1.5 kg/m2 to 4 kg/m2" to --1.5 kg/$m^2$ to 4 kg/$m^2$--.

Signed and Sealed this
Twenty-sixth Day of August, 2014

Michelle K. Lee

Michelle K. Lee
*Deputy Director of the United States Patent and Trademark Office*